US006324948B1

(12) United States Patent
Kavc et al.

(10) Patent No.: US 6,324,948 B1
(45) Date of Patent: Dec. 4, 2001

(54) SETTING FIXTURE

(75) Inventors: Andrew R Kavc, Rochester Hills; Lawrence J Lezuch, Sterling Heights; Zlatko B Stojkovic, Brownstown; Emily Zagata, Troy; Gary W Beaubien, Macomb, all of MI (US); Bradley DiTomasso, Ballwin, MO (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/633,211

(22) Filed: Aug. 7, 2000

(51) Int. Cl.[7] ..... B25B 11/00
(52) U.S. Cl. ..... 81/484; 29/271; 29/281.5
(58) Field of Search ..... 29/271, 281.5, 29/464, 468; 81/484

(56) References Cited

U.S. PATENT DOCUMENTS

| | | | | |
|---|---|---|---|---|
| 4,930,337 | * | 6/1990 | Schaap | 81/484 |
| 4,989,313 | | 2/1991 | Dzurko et al. . | |
| 5,282,305 | | 2/1994 | Nutt et al. . | |
| 5,653,012 | | 8/1997 | Pasternak et al. . | |
| 5,694,675 | | 12/1997 | Pasternak et al. . | |
| 6,006,635 | * | 12/1999 | Stojkovic et al. | 81/484 |
| 6,029,335 | * | 2/2000 | Hui et al. | 29/271 |
| 6,092,771 | * | 2/2000 | Stojkovic et al. | 29/281.5 |
| 6,209,186 | * | 4/2001 | Hui et al. | 29/271 |

OTHER PUBLICATIONS

Copending U.S. application Ser. No. 09/394,744, filed Sep. 13, 1999, Entitled: Magnetic Striker Fixture.

* cited by examiner

*Primary Examiner*—D. S. Meislin
(74) *Attorney, Agent, or Firm*—Mark P Calcaterra

(57) ABSTRACT

A tool for coupling a striker structure to a vehicle body structure in operative alignment with a latch mechanism coupled to a door structure. The tool includes a body locating portion and first and second fixture portions. The body locating portion selectively couples the tool to the vehicle body structure. The first fixture portion is coupled to the body locating portion and includes a post member for engaging a latch ratchet of the latch mechanism and an outrigger structure for engaging the door structure to thereby limit an amount by which the tool may rotate about the post member. The second fixture portion may be coupled to one of the body fixture portion and the first fixture portion. The second fixture portion includes a plate member and a latch clamp. The plate member has a slot for receiving the leg member of the striker structure with the slot having a proximal end and a generally open distal end. The latch clamp includes a clamp arm structure pivotable about an axis perpendicular to the slot between an open condition and a closed condition. The clamp arm structure pushes the striker structure against the proximal end of the slot when the clamp arm structure is positioned in the closed condition.

11 Claims, 6 Drawing Sheets

SETTING FIXTURE

BACKGROUND OF THE INVENTION

1. Technical Field

The present invention relates generally to vehicle assembly tooling and more particularly to a tool for aligning a door striker to a vehicle body.

2. Discussion

Despite widespread use of striker positioning fixtures, variations in the various components which affect striker alignment have not eliminated the need to manually verify and adjust the alignment of a striker structure to a latch mechanism. Many of the tools currently in use employ locating details that wear and effect the overall alignment between a striker structure and a latch mechanism. Further, many of these tools are based on nominal dimensions and lack the capability to be readily adjusted to accommodate for variances in the vehicle being produced and/or to improve the robustness of the tool. Consequently, vehicle manufacturers expend tremendous amounts of labor to measure the alignment between the striker and a latch mechanism, and to adjust the alignment of the striker when it is determined to be out of position.

To gage the alignment between a striker and a latch mechanism, a technician will repeatedly open and close a vehicle door to "feel" whether the striker is dragging on the latch mechanism. This process is heavily dependent upon the skill and experience of the technician and several iterations of unfastening, moving, refastening and rechecking are typically necessary to obtain satisfactory alignment.

Despite the effort that vehicle manufacturers expend to achieve proper alignment between a striker and a latch mechanism, complaints regarding improperly aligned strikers are relatively frequent. Consequently, there remains a need in the art for a tool for aligning a striker to a latch mechanism that provides more accurate results.

SUMMARY OF THE INVENTION

It is one object of the present invention to provide a tool for coupling a striker to a structure in operative alignment with a latch mechanism.

It is a more specific object of the present invention to provide a tool for aligning a striker to a latch mechanism which compensates for the variances in the manufacturing and assembly which affect striker alignment.

It is yet another object of the present invention to provide a method for aligning a striker to a latch mechanism.

In one preferred form, the present invention provides a tool for coupling a striker structure to a vehicle body structure in operative alignment with a latch mechanism coupled to a door structure. The tool includes a body locating portion and first and second fixture portions. The body locating portion selectively couples the tool to the vehicle body structure. The first fixture portion is coupled to the body locating portion and includes a post member for engaging a latch ratchet of the latch mechanism and an outrigger structure for engaging the door structure to thereby limit an amount by which the tool may rotate about the post member. The second fixture portion may be coupled to one of the body fixture portion and the first fixture portion. The second fixture portion includes a plate member and a latch clamp. The plate member has a slot for receiving the leg member of the striker structure with the slot having a proximal end and a generally open distal end. The latch clamp includes a clamp arm structure that is pivotable about an axis perpendicular to the slot between an open condition and a closed condition. The clamp arm structure pushes the striker structure against the proximal end of the slot when the clamp arm structure is positioned in the closed condition.

BRIEF DESCRIPTION OF THE DRAWINGS

Additional advantages and features of the present invention will become apparent from the subsequent description and the appended claims, taken in conjunction with the accompanying drawings wherein:

DETAILED DESCRIPTION OF THE PREFERRED EMBODIMENT

Figure 1:
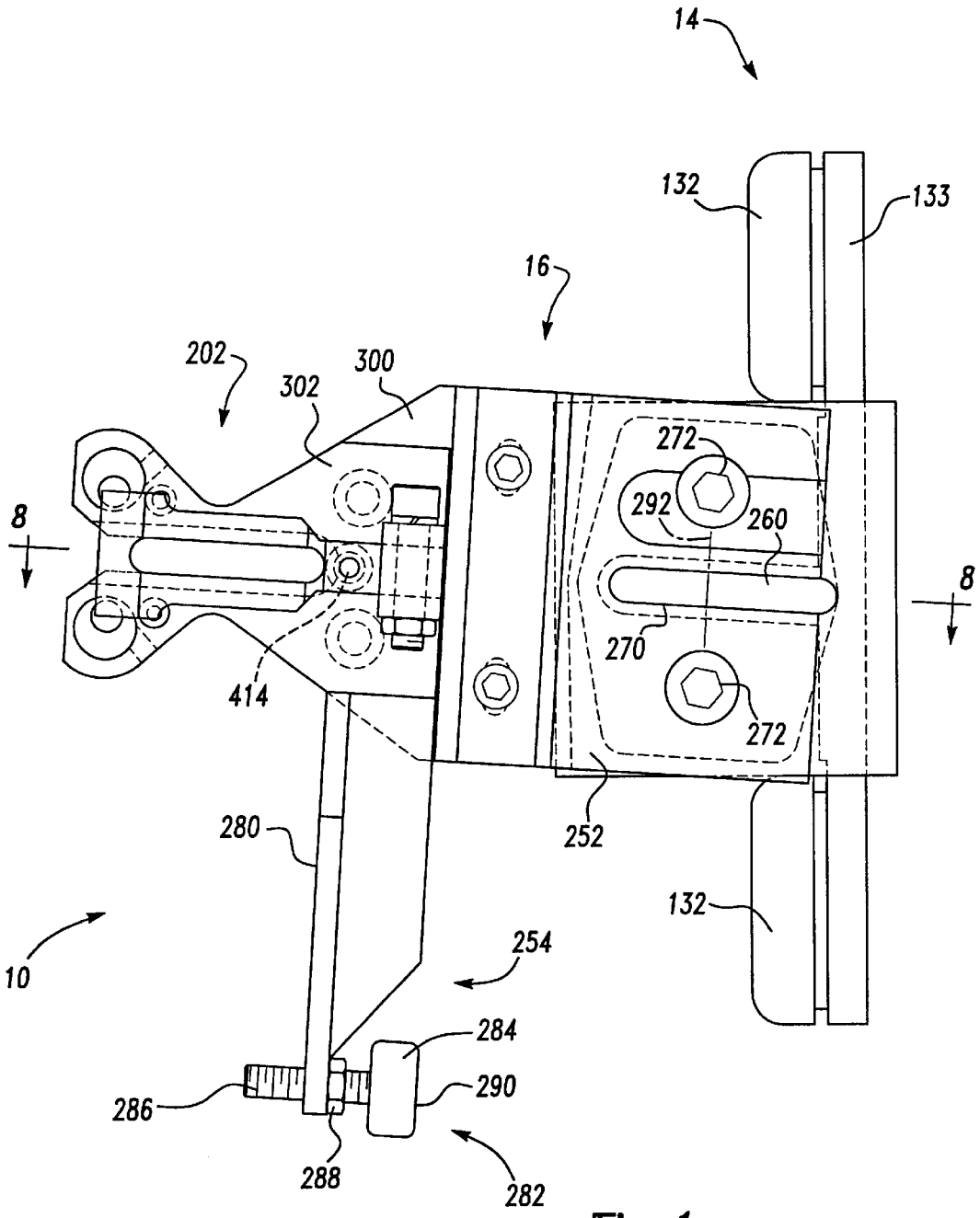
FIG. 1 is a side elevational view of the front of a tool constructed in accordance with the teaching of the present invention.

With reference to FIG. 1 of the drawings, the tool of the present invention is generally indicated by reference numeral 10. Tool 10 is shown to include a body locating portion 14 and a fixturing portion 16. Briefly, body locating portion 14 is operable for securing tool 10 to a vehicle body and fixturing portion 16 is operable for locating a striker structure relative to a latch mechanism.

Figure 2:
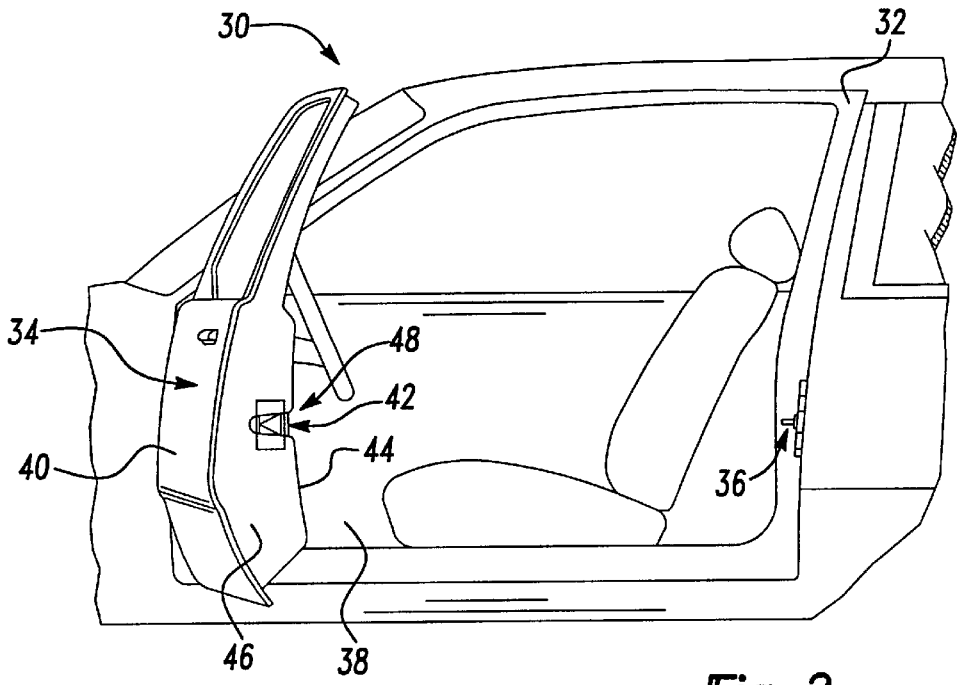
FIG. 2 is a side view of a vehicle.
Figure 3:
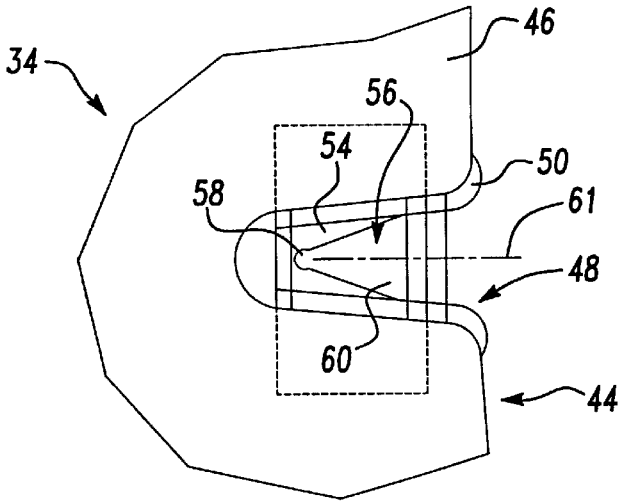
FIG. 3 is an enlarged view of a portion of the door shown in FIG. 2.
Figure 4:
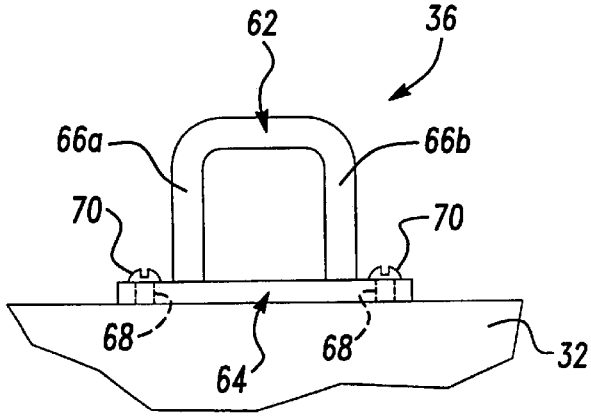
FIG. 4 is a top view of the striker shown in FIG. 2.

An exemplary vehicle 30 is illustrated in FIGS. 2 through 4, and is shown to include a vehicle body 32, a vehicle door assembly 34 and a striker structure 36. Vehicle body 32 defines a structure having a door aperture 38. Door assembly 34 is shown to be pivotably coupled to vehicle body 32 through a pair of hinges (not shown) which permit door assembly 34 to be positioned between a closed position, wherein door assembly 34 closes the door aperture 38, and an open position, wherein door assembly clears door aperture 38. Door assembly 34 includes a conventional door structure 40 and a conventional latch mechanism 42. Door structure 40 includes an outer panel 44 and a rear member 46 having a latch aperture 48.

Latch mechanism 42 includes a housing 50 and a latch ratchet 54. Latch ratchet 54 includes a striker aperture 56 which conventionally includes a first portion 58 and a second portion 60, the function of which will be discussed in further detail, below. Latch ratchet 54 is rotatably coupled to housing 50 and operable between a unlatched condition wherein the striker aperture 56 is aligned with the horizontal axis 61 of the latch ratchet 54 as shown in FIG. 3, and a latched condition wherein the striker aperture 56 has been rotated relative to the horizontal axis 61. Latch mechanism 42 is aligned to latch aperture 48 and fixedly coupled to door structure 40 such that striker aperture 56 is aligned to latch aperture 48 and striker chute 52 when latch ratchet 54 is positioned in the unlatched condition.

Striker structure 36 is illustrated as having a striker member 62 and a mounting plate 64. Striker member 62 is generally U-shaped and fixedly coupled to mounting plate 64 such that the legs 66 of striker member 62 extend perpendicularly outwardly from mounting plate 64. Mounting plate 64 includes a pair of fastener apertures 68 which permit mounting plate to be coupled to vehicle body 32 through a pair of conventional fasteners 70. When installed and properly aligned, leg 66*a* of striker member 62 is adapted to engage the second portion 60 of striker aperture 56.

Body Locating Portion

Figure 8:
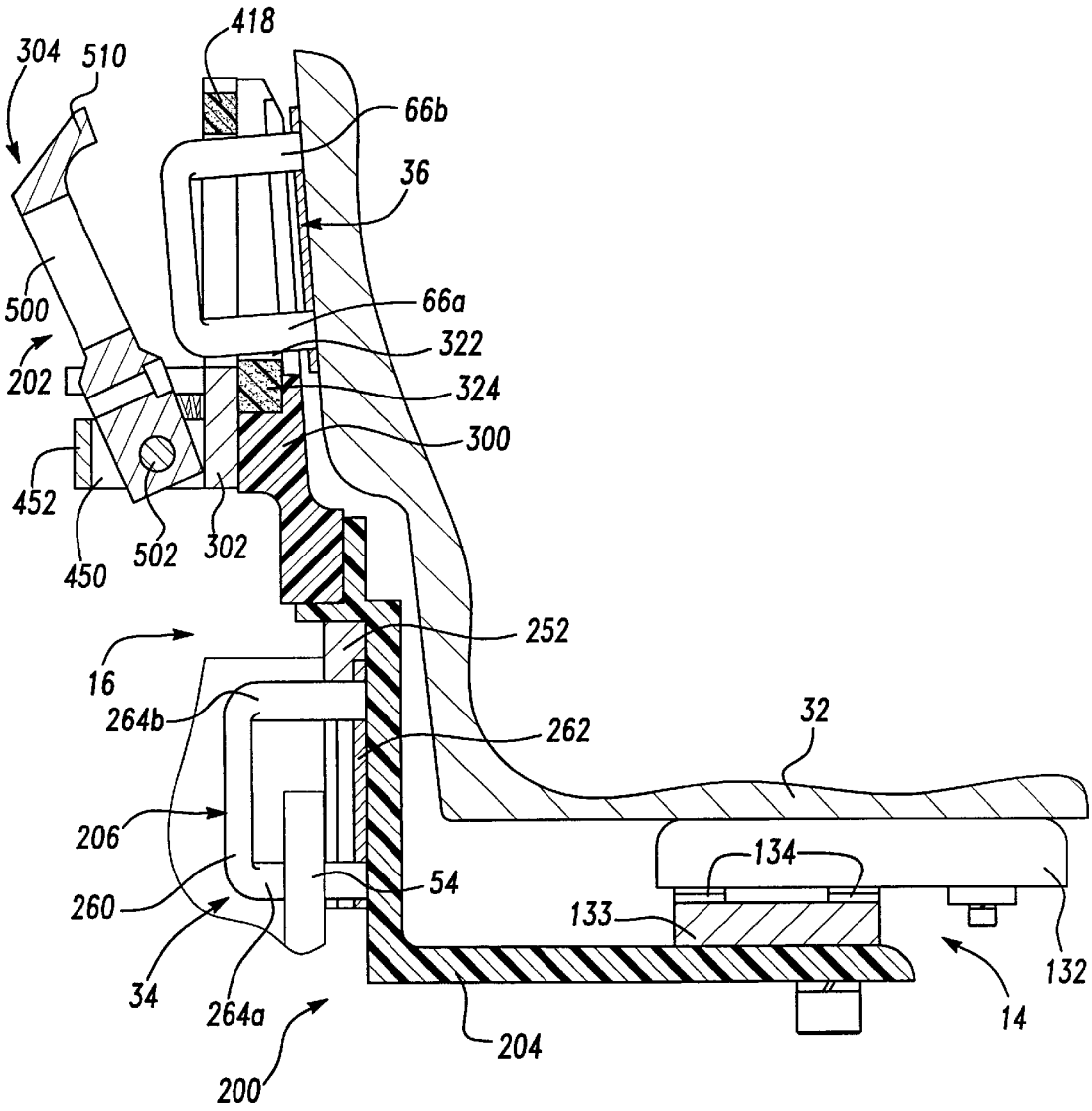
FIG. 8 is a sectional view of the tool of FIG. 1 illustrating the tool in operative association with a latch mechanism and a striker structure.

Referring back to FIG. 1, and with additional reference to FIG. 8, body locating portion 14 is operable for securing tool 10 to a vehicle body 32. In the particular embodiment illustrated, body locating portion 14 includes a pair of magnets 132, a spacer 133 and shims 134. Magnets 132 are sized to create a sufficient attractive force to couple tool 10 to vehicle body 32 such that tool 10 remains stationary relative to vehicle body 32. Magnets 132 preferably include a protective finish, such as urethane, which is adapted to prevent tool 10 from scratching or marring the finish of vehicle body 32 when tool 10 is being used. One suitable magnet is produced by Storch and marketed as their magnet number 8002-3455-027. Those skilled in the art will understand that other devices, such as vacuum suction cups, could be substituted for magnets 132.

As there may be subtle differences between vehicle models which are not easily discerned visually, magnets 132 may be coded to identify the application for which tool 10 is designed. In this regard, the shape of magnets 132 or the color of the protective finish of magnets 132 may be used to designate a particular application. In the particular example provided, a red urethane is used to indicate a 2-door application and a green urethane is used to indicate a 4-door application.

Fixturing Portion

With continued reference to FIGS. 1 and 8, fixturing portion 16 is shown to include a first fixture portion 200 and a second fixture portion 202. First fixture portion 200 includes a bracket structure 204 and a striker fixture portion 206. Bracket structure 204 is generally L-shaped and formed from a suitable structural material such as aluminum. Bracket structure 204 couples fixturing portion 16 to body locating portion 14, serving as the foundation from which magnets 132 are precisely positioned as will be described in detail, below.

Figure 5:
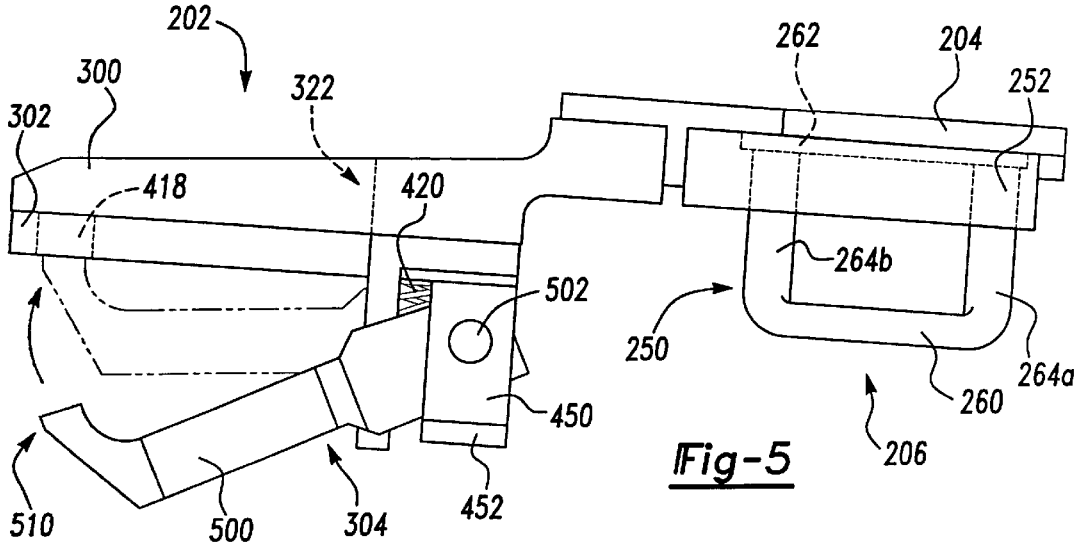
FIG. 5 is a partial top view of the tool of FIG. 1.

With additional reference to FIG. 5, striker fixture portion 206 includes a striker simulator 250, a backing member 252 and an outrigger structure 254. Striker simulator 250 is identical to striker structure 36 and need not be discussed in detail. Briefly, striker simulator 250 includes a generally U-shaped striker member 260 and a mounting plate 262. The legs 264 are fixedly coupled to mounting plate 262. The U-shaped striker member 260 of striker simulator 250 is placed in a slot 270 in backing member 252 and mounting plate 262 is placed against a face of bracket structure 204. Fasteners 272 are inserted through apertures in backing member 252 and striker simulator 250 and threadably engaged to bracket structure 204, thereby fixedly but releasably securing striker simulator 250 and backing member 252 to bracket structure 204. Backing member 252 is preferably formed from a wear resistant plastic material, such as DELRIN®, which is adapted to prevent tool 10 from scratching or marring the finish of door structure 40 when tool 10 is being used.

Outrigger structure 254 includes an outrigger member 280 that is coupled to second fixture portion 202 and depends downwardly therefrom. A bumper structure 282, preferably having a bumper member 284 formed from a resilient and non-marring material, is coupled to the distal end of outrigger member 280. Bumper structure 282 also preferably includes an adjusting means, such as a threaded rod 286 and a jam nut 288, for adjusting the location of the surface 290 of bumper member 284 relative to a vertical centerline 292 of the striker simulator 250. The surface 290 of bumper member 284 is adapted to contact the outer panel 44 of door structure 40 when striker simulator 250 is engaged to latch ratchet 54. As such, outrigger structure 254 is operable for limiting the rotation of tool 10 about latch mechanism 42 when striker simulator 264 is engaged to latch ratchet 54.

Figure 6:
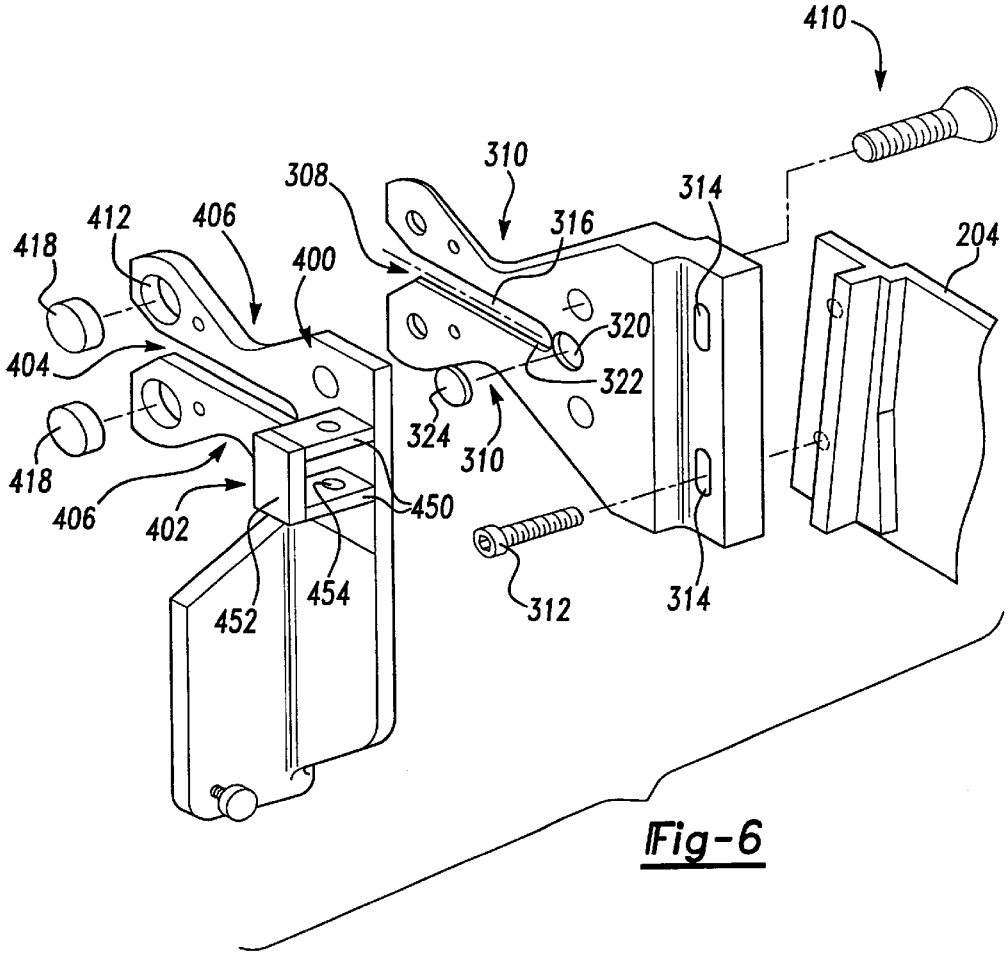
FIG. 6 is an exploded perspective view of a portion of the tool of FIG. 1.

With reference to FIGS. 1, 5 and 8, second fixture portion 202 includes a plate member 300, a support member 302 and a latch clamp 304. As best shown in FIG. 6, plate member 300 is preferably formed from a from a wear resistant plastic material, such as DELRIN®, which is adapted to prevent tool 10 from scratching or marring the finish of vehicle body 32 when tool 10 is being used. Plate member 300 includes a slotted aperture 308 which is adapted to receive the U-shaped striker member 62. Slotted aperture 308 is generally aligned parallel to the horizontal axis of the U-shaped striker member 260 of the striker simulator 250.

A pair of generally V-shaped knotches 310 are positioned vertically above and below the slotted aperture 308. The V-shaped knotches 310 permit a technician to access and tighten fasteners 70 after tool 10 has properly aligned striker structure 36. The distance between and angularity of the V-shaped knotches 310 is also configured to permit a technician to ergonomically grasp tool 10 so that tool 10 may be easily installed to door assembly 34 and removed from vehicle 30.

Fasteners 312 extend through elongated slots 314 in plate member 300 to fixedly but releasably couple plate member 300 to bracket structure 204. The elongated slots 314 are arranged parallel the vertical centerline 292 of the striker simulator 250 to permit the distance between the longitudinal axis 316 of the slotted aperture 308 and the horizontal centerline 61 of the latch ratchet 54 to be adjusted to a predetermined distance. Configuration in this manner is advantageous in that it provides a means to easily adjust tool 10 when, for example, the tool is damaged (e.g., dropped and bent).

Plate member 300 also includes a magnet aperture 320 that intersects the proximal end 322 of slotted aperture 308. Magnet aperture 320 is sized to engage a cylindrical magnet 324 in a press-fit manner. Cylindrical magnet 324 may be a Storch magnet number 8002-2325-027 and is adapted to magnetically attract leg 66*a* of striker member 62 to ensure the leg 66*a* is positioned against the proximal end 322 of slotted aperture 308.

Support member 302 stiffens plate member 300, provides a mount for latch clamp 304 and in the particular embodiment illustrated, provides a convenient attachment point for outrigger member 280. As best shown in FIG. 6, support member 302 includes a plate portion 400 and a fork structure 402. Plate portion 400 is configured to substantially match plate member 300 and as such, also includes a slotted aperture 404 and a pair of V-shaped knotches 406. Plate portion 400 and plate member 300 are fixedly but releasably coupled to one another via a plurality of fasteners 410. Plate portion 400 further includes a pair of magnet apertures 412 and a spring aperture 414 (FIG. 1). Magnet apertures 412 are sized to receive cylindrical magnets 418, such as Storch magnet number 8002-3455-030. Magnets 418 may be retained to plate portion 400 via a press-fit condition with magnet apertures 412 or may be secured in place via set screws (not shown). Spring aperture 414 is sized to receive a compression spring 420 (FIG. 5), the purpose of which will be discussed in detail, below.

Fork structure 402 includes a pair of horizontally-extending members 450 and a vertically-extending member 452. A hole 454 extends through the pair of horizontally-extending members 450 along an axis perpendicular to slotted aperture 404. Vertically-extending member 452 is secured to the distal ends of the horizontally-extending members 450 to prevent them from spreading apart.

As best shown in FIG. 5, latch clamp 304 includes a clamp arm structure 500 that is pivotably coupled to the horizontally-extending members 450 via a hinge pin 502. Clamp arm structure 500 is rotatable about hinge pin 502 between an open position (as shown in solid lines in FIG. 5) and a closed position (as shown in phantom in FIG. 5). Clamp arm structure 500 is biased toward the open position by compression spring 420. Vertically-extending member 452 inhibits clamp arm structure 500 from pivoting away from plate portion 400 beyond a predetermined point. The tip 510 of clamp arm structure 500 is configured to push striker structure 36 toward the proximal end 322 of slotted aperture 308 when clamp arm structure 500 is closed and a striker structure 36 is disposed within slotted aperture 308. Magnets 418 are operable for providing a force which maintains the clamp arm structure 500 in the closed position when the clamp arm structure 500 is pivoted into contact with a striker structure 36.

Tool Operation

As shown in FIG. 2, striker structure 36 is placed proximate vehicle body 32 and fasteners 70 are inserted through fastener apertures 68 and threadably engaged to vehicle body 32. Each of fastener 70 is threaded into the vehicle body until its head is approximately 3 mm away from mounting plate 64. As such, striker structure 36 is only loosely coupled to vehicle body 32 to permit tool 10 to position striker structure 36 in a desired manner.

Figure 7:
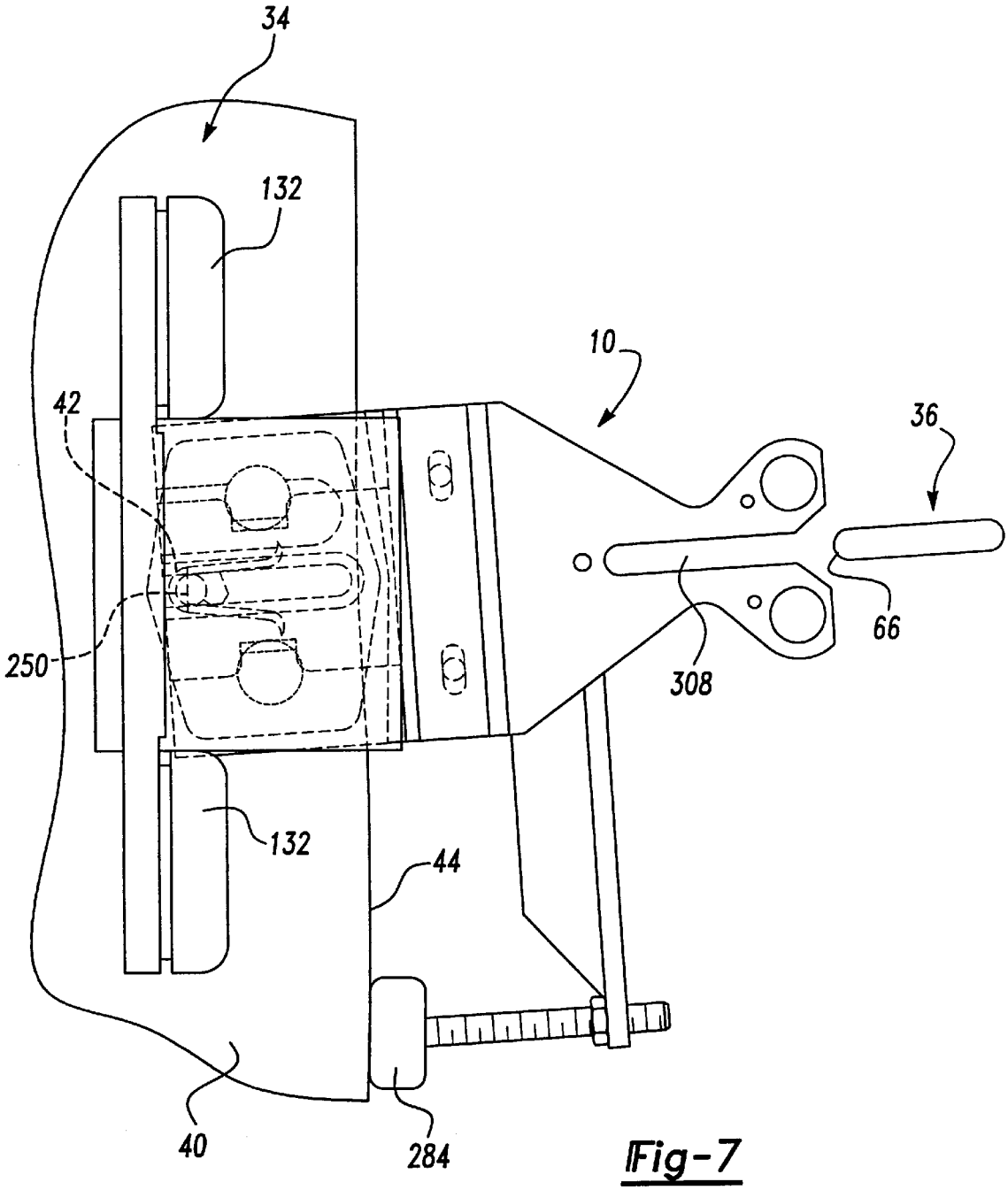
FIG. 7 is a side elevational view of the rear of the tool of FIG. 1.

In FIG. 7, tool 10 is placed against door assembly 34 and striker simulator 250 is engaged to latch mechanism 42 (i.e., the leg 264*a* of striker simulator 250 is engaged into the first portion 60 of latch ratchet 54). Simultaneously, the bumper member 284 is positioned to contact the outer panel 44 of the door structure 40 to limit the amount by which the tool 10 is permitted to pivot within the first portion 60 of latch ratchet 54. Door assembly 34 is pivoted toward the closed position until the legs 66 of the striker structure 36 are received into the slotted aperture 308 and the magnets 132 contact vehicle body 32 as shown in FIG. 8.

Figure 9:
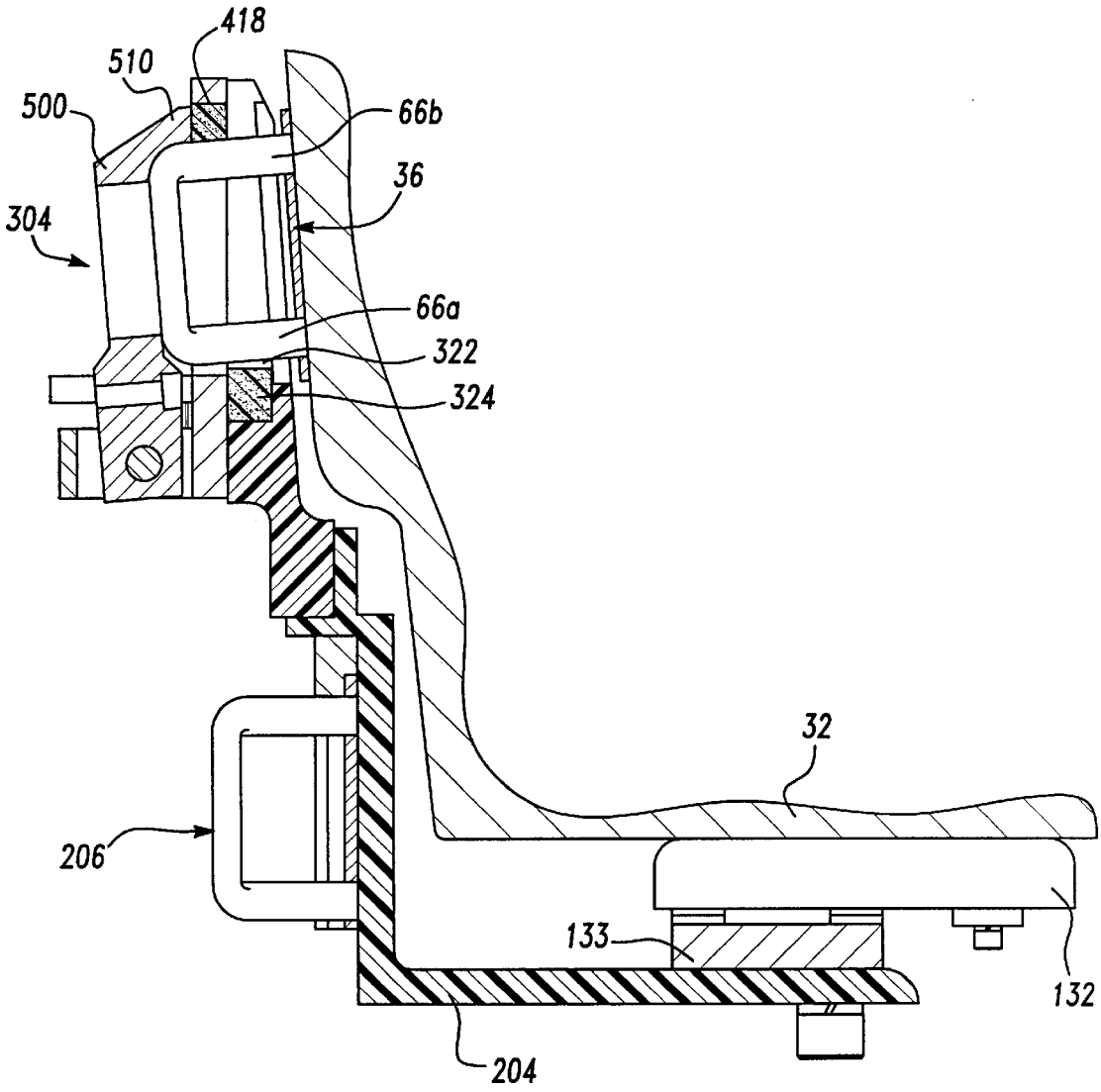
FIG. 9 is a sectional view similar to FIG. 8 but illustrating the clamp arm structure in a closed position.

Latch mechanism 42 is next actuated to rotate latch ratchet 54 and release striker simulator 250. Door assembly 34 is rotated toward the open position to permit access to striker structure 36. As illustrated in FIG. 9, clamp arm structure 500 is next pivoted toward striker structure 36. Tip 510 is contoured to contact striker structure 36 and push it toward the proximal end 322 of the slotted aperture 308. Magnet 324 assists in positioning striker structure 36 by exerting a force which tends to draw striker structure 36 toward magnet 324 and the proximal end 322 of the slotted aperture 308. Magnets 418 overcome the biasing force of compression spring 420 and retain clamp arm structure 500 in the closed position, trapping striker structure 36 between the proximal end 322 of slotted aperture 308 and tip 510. A conventional fastening tool (not shown) is then utilized to tighten fasteners 70. Clamp arm structure 500 is then rotated away from striker structure 36 and tool 10 is removed from vehicle 30 for its next use.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the description of the appended claims.

What is claimed is:

1. A tool for coupling a striker structure to a vehicle body structure in operative alignment with a latch mechanism, the striker structure having a plate member and a leg member extending therefrom, the latch mechanism coupled to a door structure and having a latch ratchet for engaging the leg member, the vehicle body and door structures pivotably coupled to one another, the tool comprising:

a body locating portion for selectively coupling the tool to the vehicle body structure;

a first fixture portion coupled to the body locating portion, the first fixture portion having a post member and an outrigger structure, the post member adapted for engagement with the latch ratchet, the outrigger structure adapted to engage the door structure to thereby limit an amount by which the tool may rotate about the post member; and a second fixture portion coupled to one of the body locating portion and the first fixture portion, the second fixture portion having a plate member and a latch clamp, the plate member including a slot adapted to receive the leg member of the striker structure, the slot having a proximal end and a generally open distal end, the latch clamp having a clamp arm structure pivotable about an axis perpendicular to the slot between an open condition and a closed condition, the clamp arm structure adapted to push the striker structure against the proximal end of the slot when the clamp arm structure is positioned in the closed condition.

2. The tool of claim 1, further comprising spring means for biasing the clamp arm structure toward the open condition.

3. The tool of claim 2, further comprising a magnet coupled to the plate member and operable for applying a force to the clamp arm structure to overcome a force exerted by the spring means and retain the clamp arm structure in the closed position when the clamp arm structure is rotated to the closed position.

4. The tool of claim 1, wherein the body fixture portion includes a magnet for coupling the body locating portion to the vehicle body structure.

5. The tool of claim 1, wherein the location of the clamp arm structure is stationary relative to the location of the slot.

6. The tool of claim 1, wherein the outrigger structure includes a downwardly depending outrigger member and a bumper member adapted to contact the door structure.

7. The tool of claim 6, wherein the bumper member is formed from a resilient material.

8. The tool of claim 6, wherein the bumper member includes an adjusting means for adjusting an angle between the longitudinal axis of the slot and a centerline of the latch ratchet.

9. The tool of claim 1, wherein the first and second fixture portions are fixedly but adjustably coupled to one another such that a vertical distance between a longitudinal axis of the slot and a centerline of the latch ratchet may be tailored to a predetermined distance.

10. A method for coupling a striker structure to a vehicle body structure in operative alignment with a latch mechanism, the striker structure having a plate member and a leg member extending therefrom, the latch mechanism coupled to a door structure and having a latch ratchet for engaging the leg member, the vehicle body and door structures pivotably coupled to one another, the method comprising the steps of:

providing a tool with a body locating portion, a first fixture portion and a second fixture portion, the first fixture portion having a post member and an outrigger structure, the second fixture portion coupled to one of the body locating portion and the first fixture portion, the second fixture portion having a plate member and a latch clamp, the plate member including a slot having a proximal end and a generally open distal end, the latch clamp having a clamp arm structure pivotable about an axis perpendicular to the slot between an open condition and a closed condition;

coupling the first fixture portion of the tool to the latch mechanism such that the latch ratchet engages the post member and the outrigger structure engages a surface of the door structure;

pivoting the door structure toward the vehicle body structure such that the body locating portion contacts the vehicle body structure and the striker structure is disposed within the slot;

positioning the striker structure with the clamp arm structure; and securing the striker structure to the vehicle body structure.

11. The method of claim 10, wherein in the step of positioning the striker structure, the clamp arm structure is rotated to the closed position wherein the clamp arm structure pushes the striker structure against the proximal end of the slot.

* * * * *